United States Patent [19]

Hallcher et al.

[11] 4,293,392

[45] Oct. 6, 1981

[54] ALKYLATION OF NITRILES USING AN ELECTROGENERATED BASE AND AN ALKYLATING AGENT

[75] Inventors: Richard C. Hallcher, Maryland Heights; Richard D. Goodin, St. Louis, both of Mo.; Manuel M. Baizer, Santa Monica, Calif.

[73] Assignee: Monsanto Company, St. Louis, Mo.

[21] Appl. No.: 112,879

[22] Filed: Jan. 17, 1980

[51] Int. Cl.[3] ..... C25B 3/04; C25B 3/10

[52] U.S. Cl. ..... 204/59 R; 204/72; 204/73 R

[58] Field of Search ..... 204/59 R, 72, 73 R

[56] References Cited

U.S. PATENT DOCUMENTS

| | | | |
|---|---|---|---|
| 3,438,877 | 4/1969 | Baizer | 204/73 R |
| 4,072,583 | 2/1978 | Hallcher et al. | 204/59 R |
| 4,132,611 | 1/1979 | Baizer et al. | 204/59 R |

*Primary Examiner*—F. Edmundson

*Attorney, Agent, or Firm*—L. Bruce Stevens; James W. Williams, Jr.; Joseph D. Kennedy

[57] ABSTRACT

The invention is a process for alkylating nitriles using an electrogenerated base and an alkylating agent comprising (a) electro-reducing an azobenzene probase at a cathode in an electrolysis medium comprising the azobenzene probase, a nitrile and a supporting electrolyte to produce an electrogenerated base, (b) deprotonating the nitrile with the electrogenerated base to produce a nitrile anion, and (c) reacting the nitrile anion with alkylating agent to form alkylated nitrile; the probase being more easily electro-reducible than the nitrile and producing an electrogenerated base strong enough to deprotonate the nitrile which is sufficiently acidic to permit such deprotonation, and the electrogenerated base not reacting readily, unless rapidly reversibly, with the alkylating agent.

4 Claims, No Drawings

ALKYLATION OF NITRILES USING AN ELECTROGENERATED BASE AND AN ALKYLATING AGENT

This invention is related to patent application Ser. No. 84,940, filed Oct. 15, 1979, on Alkylating of Nitrogen Acids Using Electrogenerated Bases as Catalysts.

BACKGROUND OF THE INVENTION

This invention relates to a process using an electrogenerated base as catalyst for the alkylation of nitriles.

In U.S. Pat. No. 4,132,611, Baizer et al, there is described the use of electrogenerated bases as catalysts for the addition of organic electrophiles to carbon acids, and certain other related prior art is described therein. One of the reactions described in this patent is alkylation of the carbon acid and this is described broadly in column 3, lines 15–27 of the patent.

SUMMARY OF THE INVENTION

The invention is a process for alkylating nitriles using an electrogenerated base and an alkylating agent comprising (a) electro-reducing an azobenzene probase at a cathode in an electrolysis medium comprising the azobenzene probase, a nitrile and a supporting electrolyte to produce an electrogenerated base (b) deprotonating the nitrile with the electrogenerated base to produce a nitrile anion, and (c) reacting the nitrile anion with alkylating agent to form alkylated nitrile; the probase being more easily electro-reducible than the nitrile and producing an electrogenerated base strong enough to deprotonate the nitrile which is sufficiently acidic to permit such deprotonation, and the electrogenerated base not reacting readily, unless rapidly reversibly, with the alkylating agent.

The nitrile reactants of the invention are of the formula $R'_2CHCN$ in which R' can be H or hydrocarbyl which can be alkyl, aralkyl, alkaryl or aryl, normally having not more than 10 carbon atoms. The nitrile anions produced by deprotonating $R'_2CHCN$ are of the formula $R'_2C^-CN$ where R' is as defined hereinabove.

The alkylating agent is characterized by the formula $R''CH_2CH_2CH_2Z$ where Z is a "leaving group" like halide, tosylate, sulfonate, sulfate, and R'' is H, Z or hydrocarbyl which can be alkyl, aralkyl, alkaryl or aryl, normally having not more than 10 carbon atoms.

The alkylated nitrile produced by reacting $R'C^-CN$ and $R''CH_2CH_2CH_2Z$ is of the formula $R'''CH_2CH_2CH_2CR'_2CN$ where R' is as defined hereinabove and R''' is H, $CR'_2CN$ or hydrocarbyl having not more than 10 carbon atoms.

Typical among the probases which generally satisfy the requirements of the process of the invention, including reoxidation capability, are azobenzenes of the formula

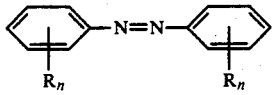

wherein n is at least one and each R is branched-chain alkyl, having from 3 to 6 carbon atoms, e.g. isopropyl, t-butyl, isoamyl, isohexyl and the like, is quite satisfactory for R although longer chain alkyl is also suitable. At least one R on each phenyl ring must be in an ortho position and both ortho positions on each phenyl ring can have R groups. It is preferred that R groups not in ortho position be in para position.

The high basicity of azobenzene anion radicals such as hexa-alkyl azobenzene anion radicals are due to combination of stearic prevention of ring coplanarity by the alkyl groups in the ortho-positions and an electronic effect of multiple alkyl substitution. High basicity can also be accomplished by fewer than alkyl groups in all ortho positions, provided the alkyl groups in the ortho positions are sufficiently bulky to prevent alkylation at nitrogen, and stronger electron-donating substituents are in the para-position (e.g. alkoxy, dialkylamino and the like).

These azobenzenes such as hexaisopropylazobenzene used in the process of the invention form remarkable basic anion radicals on reduction to the extent that they deprotonate nitriles such as acetonitrile, and yet these basic anions are not alkylated by the alkylating agent for the nitrile, e.g. butyl chloride, but rather function only as a base. Furthermore, the hydrazobenzene produced by deprotonation of acetonitrile can be oxidized to azobenzene by anodically generated bromine permitting catalytic use of the base.

The solvents employed in the present process are an excess of the nitrile reactant or a nonreactive solvent such as dimethylformamide or N,N-dimethylacetamide can be used, if desired.

Certain salts of alkali metals, amine and quaternary ammonium salts, or mixtures of such can be employed as supporting electrolytes. Among the alkali metal salts useful are lithium, sodium, and potassium salts. Among the quaternary ammonium salts useful are the tetraalkylammonium, for example, tetramethylammonium, tetraethylammonium, tetra-n-propylammonium, and the like, heterocyclic and alkylarylammonium salts, for example, phenyltriethylammonium and the like, with the tetralkylammonium salts being generally preferred because of their good solubility and conductivity and because they are difficultly reduced.

Various anions can be used with the foregoing and other cations, for example, halides such as chlorides, bromides, iodides, perchlorates, tetrafluoroborates, hexafluorophosphates, sulfonates, tetraphenylborides and the like.

The concentration of electrolyte salt is not narrowly critical. Thus, for example, suitable concentrations will often be in the range of about 1 percent to about 10 percent by weight of the electrolysis medium or on a molar basis often in the range of about one thousandth to about one molar. The only limitation on the amount of electrolyte salt employed is that the amount is sufficient to promote efficient and economical operation and that it is soluble in the electrolysis medium.

If undivided cells are utilized for carrying out the process of the invention or if regeneration of the probase is carried out in a divided cell, a scavenger is needed which is capable of capturing protons (or water) to produce innocuous scavenger reaction products. Scavengers suitable for the present process are alkali metal carbonates; alkali metal salts of very weak and very insoluble acids, for example, alkali metal tetraborates; basic alumina (which contains alkali metal aluminates, for example, sodium aluminates); acid-type ion-exchange resins in the alkali metal form, for example, sulfonic acid-type ion exchange resins in the sodium form, epoxides for example, 1,2-epoxybutane.

In the present process, either an undivided or a divided electrolysis cell can be employed. A divided cell contains a suitable barrier material or separator which will prevent the free flow of reactants between the cathode and anode. Normally, in the process of the present invention, a divided cell is preferred. It will be appreciated that the electrolysis cells employed in the examples are primarily for laboratory demonstration purposes and production cells are usually designed with a view to the economics of the process. For a general description of various laboratory scale cells, see Lund et al, "Practical Problems in Electrolysis," in Organic Electrochemistry (Baizer, ed) Marcel Dekker, New York, 1973, pp. 165–249, and for some consideration of industrial cell designs, see Danly, "Industrial Electroorganic Chemistry," in ibid, pp. 907–946. The present process is suited to batch, semi-continuous, or continuous operations.

For convenience, temperatures in the range of about 0° to about 100° C. can be used with temperatures between 20° C. and about 55° C. being preferred. The process can be conducted at atmospheric pressure, superatmospheric pressures, and subatmospheric pressures. However, for reasons of economy and ease of construction of equipment employed in the present process, it is preferred to conduct this process at approximately atmospheric pressure.

The following examples indicate the present invention and the manner by which it can be practiced.

EXAMPLE 1

A divided cell having a cathode compartment and an anode compartment separated by a glass frit was employed. The cathode was a mercury pool and the anode was a carbon rod.

One hundred forty milliliters (ml) of acetonitrile containing 5.2 grams of tetrabutylammonium perchlorate (70 ml to cathode compartment and 70 ml to anode compartment) were charged to the cell. Also charged to the cathode compartment were 0.434 grams (0.001 mole) of 2,2',4,4',6,6'-hexaisopropylazobenzene dissolved in 5 ml of toluene and 1.84 grams of butyl chloride.

Reduction was carried out at the cathode at −1.8 volts measured by comparison with a standard calomel electrode (SCE). Reduction continued until 2.03 faradays/mole of the azo compound had been passed (55,000 counts vs. 54,091 theory), and when reduction was complete the initial current of 110 milliamperes (mA) had dropped to 9 mA.

The excess acetonitrile was evaporated, the residue triturated with ether, filtered, dried and the ether evaporated. Gas chromatography showed the product contained hexanenitrile in 16% integrated area yield. This was confirmed by nuclear magnetic resonance (nmr).

EXAMPLE 2

The experiment of Example 1 was repeated except that 2.28 g. of butyl tosylate was substituted for the butyl chloride, and 2.24 g. of tetraethylammonium tosylate was substituted for the tetrabutylammonium perchlorate.

A gas chromatographic analysis of the product showed 35% current efficiency in forming the desired hexanenitrile product.

EXAMPLE 3

The same cell as used in Example 1 was used in this experiment. To the cathode compartment was charged 0.828 grams (0.002 moles) of 2,2',4,4',6,6'-hexaisopropylazobenzene, 2.7 grams of tetrabutylammonium perchlorate, 0.002 moles of 1,4-dichlorobutane and 75 ml of acetonitrile. To the anode compartment was charged 2.59 grams of tetrabutylammonium bromide, 2.0 grams of 1-hexene and 75 ml of acetonitrile.

Reduction was carried out at −1.9 volts and a current of 80 mA till 4.02 faraday per mole (108,507 counts vs. 108,000 theory) of azo compound of electricity had been passed.

The product was recovered in a manner similar to that of Example 1, and vapor phase chromatography (vpc) indicated a mixture of products with the major product being suberonitrile which has the formula $CN(CH_2)_6CN$.

Other experiments were carried out in a manner similar to Example 1 using 1,2-dichloroethane and acetonitrile in an attempt to prepare adiponitrile, but these experiments were unsuccessful. It is believed that the failure of these experiments may have been due to elimination of HCl from dichloroethane giving vinyl chloride, although this was not demonstrated.

The alkylated nitriles produced by the process of the invention can be readily converted to amides, acids or esters by well-known conventional chemical methods.

Although the invention has been described in terms of specified embodiments which are set forth in considerable detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A process for alkylating nitriles using an alkylating agent and an electrogenerated base comprising (a) electro-reducing an azobenzene probase of the formula

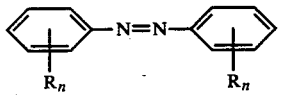

where n is at least one and each R is branched-chained alkyl having from 3 to 6 carbon atoms with at least one R on each phenyl ring being in an ortho position, at a cathode in an electrolysis medium solvent containing a nitrile of the formula $R'_2CHCN$ wherein R' is H or hydrocarbyl having not more than 10 carbon atoms, comprising the probase, the nitrile and a supporting electrolyte to produce an electrogenerated base;

(b) deprotonating the nitrile with the electrogenerated base to produce a nitrile anion; and (c) reacting the nitrile anion with an alkylating agent of the formula $R''CH_2CH_2CH_2Z$ wherein Z is a leaving group and R'' is H, Z or hydrocarbyl having not more than 10 carbon atoms, to produce an alkylated nitrile;

the aforesaid probase being more easily electro-reducible than the nitrile and producing an electro-generated base strong enough to deprotonate the nitrile which is sufficiently acidic to permit such deprotonation, and the electro-generated base not reacting readily, unless rapidly reversible, with the alkylating agent.

2. A process of claim 1 wherein said probase is hexaisopropylazobenzene.

3. A process of claim 2 wherein said nitrile is acetonitrile, said alkylating agent is chlorobutane, and said alkylated nitrile comprises hexanenitrile.

4. A process of claim 2 wherein said nitrile is acetonitrile, said alkylating agent is 1,4-dichlorobutane, and said alkylated nitrile comprises suberonitrile.

* * * * *